United States Patent [19]

Houtman

[11] Patent Number: 4,854,857

[45] Date of Patent: Aug. 8, 1989

[54] TORCH IGNITOR

[75] Inventor: William H. Houtman, Ann Arbor, Mich.

[73] Assignee: Gas Research Institute, Chicago, Ill.

[21] Appl. No.: 275,775

[22] Filed: Nov. 23, 1988

[51] Int. Cl.[4] ..... F23D 11/36

[52] U.S. Cl. ..... 431/154; 431/258; 431/263; 431/264

[58] Field of Search ..... 431/154, 191, 193, 258, 431/263, 264, 266, 349; 219/267

[56] References Cited

U.S. PATENT DOCUMENTS

| | | | |
|---|---|---|---|
| 2,880,792 | 4/1959 | Raskin | 431/266 |
| 3,073,121 | 1/1963 | Baker et al. | 431/266 X |
| 3,718,425 | 2/1973 | Weyl et al. | 431/263 X |
| 4,669,974 | 6/1987 | Sawada et al. | 431/263 X |

*Primary Examiner*—Randall L. Green

*Attorney, Agent, or Firm*—Brooks & Kushman

[57] ABSTRACT

An electric spark type torch ignitor comprises an ignitor housing tube within which is disposed an electric ignitor. The ignitor housing tube has open forward and rear ends. The forward end is fitted to an annular shelter chamber within which the forward tip end of the electric ignitor is disposed. The electric ignitor is slid into the ignitor housing tube via the open rear end, and is located within the tube by means of several circumferentially spaced dimples that project inwardly from the wall of the tube, the electric ignitor having a shoulder that abuts these dimples. The dimples have inclined surfaces that act upon the shoulder in such a manner that the electric ignitor is centered within the tube so that an annular passageway is created around the electric ignitor within the tube. A resilient retaining spring clip acts to resiliently urge the electric ignitor forwardly within the ignitor housing tube thereby keeping the electric ignitor's shoulder against the dimples. Because the ignitor housing tube is located with respect to the shelter chamber, the tip of the electric ignitor is also located with respect to the shelter chamber. A combustible mixture is passed forwardly through the annular passage into the shelter chamber where it is ignited by a spark from the ignitor tip to create a flame that is emitted from the forward end of the torch ignitor.

15 Claims, 3 Drawing Sheets

TORCH IGNITOR

BACKGROUND AND SUMMARY OF THE INVENTION

This invention relates to a torch ignitor of the type that is utilized in a combustion device to initiate the combustion of a combustible mixture within the combustion device. More specifically, the invention relates to a new and unique torch ignitor which, by means of an electric spark, ignites a small combustible mixture flowing through the torch ignitor to create a flame that is emitted at the front end of the torch ignitor and is directed into a main combustion chamber to ignite a much larger combustible mixture that is introduced into the combustion chamber.

The use of an electric spark type torch ignitor to ignite a combustible mixture in a combustion device is well known. Various examples of this type of torch ignitor are found in prior patents. A preliminary novelty search conducted in respect of this invention developed the following U.S. patents.

| | | | |
|---|---|---|---|
| Benson | 2,493,743 | Raskin | 2,880,792 |
| Frank | 2,285,704 | Johnston | 3,330,985 |
| Piros et al | 2,668,592 | Morishita | 4,215,979 |

The Raskin U.S. Pat. No. 2,880,792 is relevant to the present invention. It shows an ignitor in which the electrode tip is located in a sheltered area of the ignitor so that it is not exposed to the main combustion chamber of the combustion device. Sheltering of the electrode tip in a location outside the main combustion chamber is desirable in order to minimize tip erosion.

The Raskin device comprises a first tube onto the front end of which the rear end of a second tube is partially telescoped. Gas is introduced at the rear end of the first tube and passes through the first tube. Air admission slots are provided in the wall of the second tube just beyond where it partially telescopes onto the first tube. Air enters these slots to mix with the gas that has passed through the first tube. The mixture continues through the second tube passing over the ignitor electrode tip which is located within the second tube toward the front end thereof. When the ignitor is energized, a spark is created between the electrode tip and the wall of the second tube, and this spark ignites the combustible mixture. The combustible mixture is discharged as a flame at a nozzle which is formed at the front end of the second tube.

The ignitor structure of the Raskin device comprises a spark plug that is arranged coaxially with the first tube and is screwed into a threaded opening in a spark plug holder structure that is itself threaded onto the rear end of the first tube in the vicinity of where the gas is introduced into the first tube. The ignitor comprises a metal rod that passes coaxially through both tubes, terminating within the second tube in the electrode tip. The tip is bent at a right angle to the main extent of the wire rod. A threaded connector element threads into one end of the spark plug and into the rear end of the metal rod to connect the two. A porcelain insulating sleeve is disposed around the concentric portion of the metal rod, and means are provided on the wall of the first tube for centering the insulating sleeve, and hence the main extent of the metal rod, with respect to the two tubes.

The remaining patents mentioned above show other arrangements for constructing electric type torch ignitors and/or for sheltering the electrode tip.

Virtually all these prior devices appear to have a fixed mounting on the combustion device, typically by some type of a threaded joint located at or near the rear end of the device. Hence axial expansion and contraction, that occur in response to changing thermal conditions, could create a certain amount of change in the location of the tip relative to its surrounding structure depending upon the particular temperature changes to which the particular device is exposed. If an attempt were made to maintain a fixed location for the electrode tip and provision were not made for compensating for axial expansion and contraction, there could be instances where excessively high stresses are induced in an ignitor.

Where an ignitor comprises an electrode structure which is embedded in or otherwise surrounded by an insulating ceramic material, failure to compensate for thermally induced mechanical stresses, while attempting to maintain tip location, may result in ignitor failure due to fracture of the ceramic material. It does not appear that the prior art has addressed this potential problem.

The present invention relates to a new and improved torch ignitor in which the location of the electrode tip is accurately maintained even though the device itself may be subjected to a range of thermal conditions. The torch ignitor of the present invention also comprises a construction in which thermally induced mechanical stresses are minimized. As a result, the torch ignitor of the present invention is seen to be capable of providing a longer service life with less likelihood of breakage or malfunction. Moreover, if it becomes necessary to replace the ignitor, such replacement can be conveniently and expeditiously accomplished once access to the rear of the torch ignitor has been attained.

Briefly, the torch ignitor of the present invention comprises an ignitor housing tube having its front end fixedly referenced to a shelter chamber for the electrode tip. The electrode tip of the ignitor is fixedly referenced to the shelter chamber by inserting the ignitor into the ignitor housing tube until a shoulder on the ignitor comes into contact with an abutment on the wall of the ignitor housing tube that is in a predetermined relationship to the means which locates the ignitor housing tube with respect to the shelter chamber. In this way the electrode tip is located in a desired position within the shelter chamber when the ignitor is inserted into the ignitor housing tube.

Maintenance of the axial position of the ignitor within the ignitor housing tube is achieved by means of several parts which serve to resiliently urge the ignitor axially within the ignitor housing tube to maintain the ignitor shoulder in contact with the abutment. These several parts comprise a retainer cap that is shaped to fit onto the open rear end of the ignitor housing tube and to engage the ignitor through an O-ring seal that seals between the outside of the ignitor and the inside of the ignitor housing tube at the rear of the torch ignitor. A retaining clip spring is fastened between a fixed location on the combustion device and the retainer cap and serves to urge the retainer cap in the forward direction so that the ignitor is in turn maintained in contact with the abutment the ignitor housing tube's wall. The retaining clip spring has a certain resiliency which allows for thermally induced expansion and contraction of the assembled parts whereby expansion is taken up by increased flexing of the retaining clip spring and contraction by decreased flexing. In this way, any build-up of major mechanical stresses in the ignitor housing tube and in the ignitor are avoided.

The foregoing features, advantages and benefits of the invention, along with additional ones, will be seen in the ensuing description and claims which should be considered in conjunction with the accompanying drawings. The drawings disclose a presently preferred embodiment of the invention according to the best mode contemplated at the present time in carrying out the invention.

DESCRIPTION OF THE PREFERRED EMBODIMENT

Figure 1:
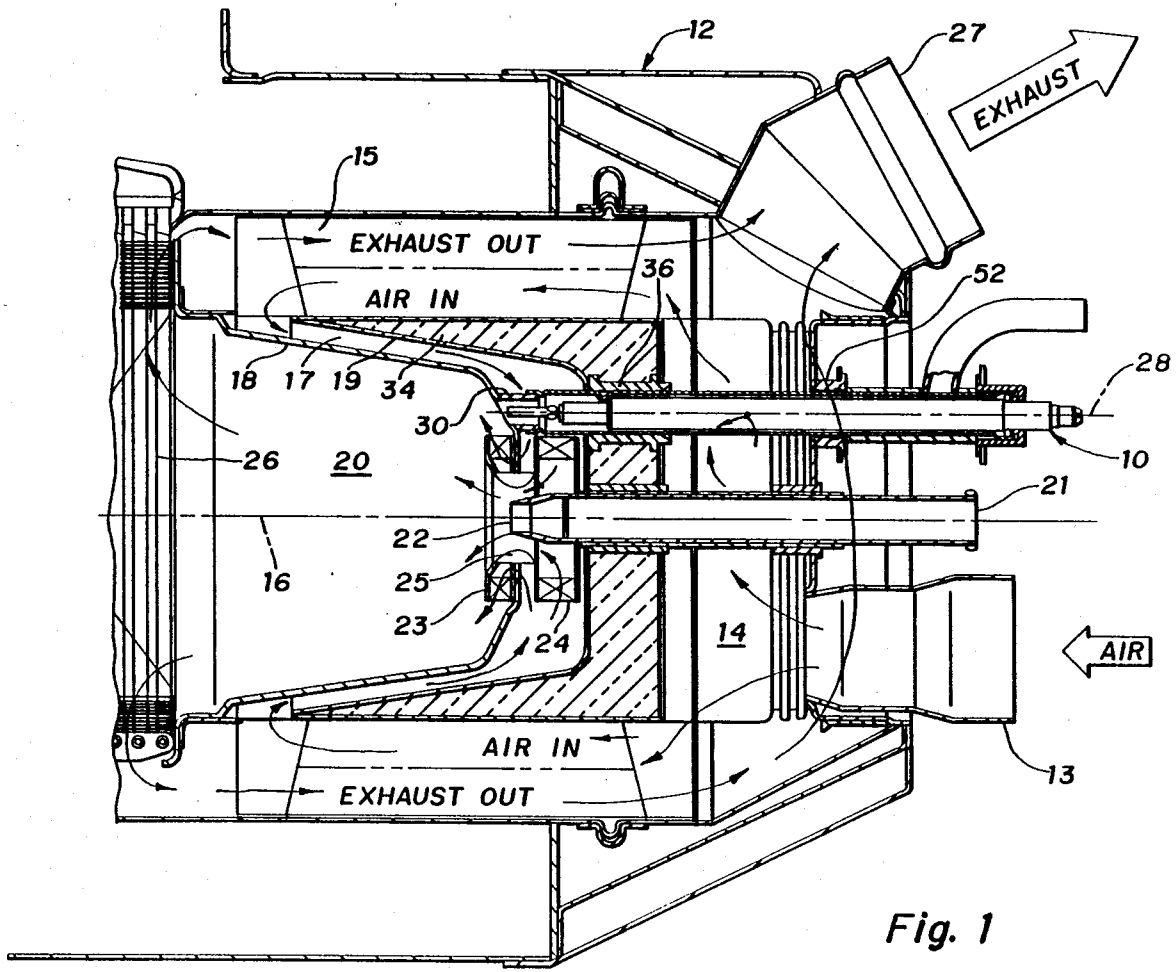
FIG. 1 is a longitudinal cross sectional view through a combustion device containing a torch ignitor according to the invention.

The drawings show a presently preferred embodiment of torch ignitor 10 in accordance with principles of the present invention. In FIG. 1, torch ignitor 10 is illustrated in a representative use in a combustion device 12 of the same general type that is shown in U.S. Pat. No. 4,676,736, issued June 30, 1987 and commonly assigned.

Combustion device 12 comprises an air inlet 13 leading to an air plenum 14. The plenum is pressurized with air by means of a blower (not shown) that is located upstream of air inlet 13. From plenum 14 the air passes in the direction of the arrows labeled "AIR IN" through an annular shaped recuperative preheater 15 that is disposed generally coaxially with the main axis 16 of the combustion device. The preheater comprises a series of axially extending passages that are circumferentially side by side and it is the circumferentially alternate ones of these passages that convey the inlet air through the preheater.

After passing through the preheater, the inlet air flow is reversed in direction to pass inwardly through an annular space 17 that is cooperatively defined by the combustion chamber wall 18 and a further wall 19 that is spaced rearwardly of the combustion chamber wall. The combustion chamber wall 18 bounds a combustion chamber 20 within which combustion takes place.

The combustion device still further comprises a main gas feed tube 21 that is arranged coaxial with axis 16 and which emits a gaseous fuel into combustion chamber 20 via a nozzle structure 22 at the forward end thereof. Disposed in surrounding relation to the nozzle end of tube 21 are a pair of swirlers 23, 24 and a venturi 25. These two swirlers and venturi have an organization and arrangement for creating a combustible mixture within combustion chamber 20 that is derived from the inlet air flow and the gaseous fuel emitted from gas tube 21. More specific details of the organization and arrangement of the two swirlers and the venturi to create the combustible mixture in cooperation with gas tube 21 may be found in the above referenced commonly assigned patent. The combustible gas mixture in chamber 20 is ignited by means of torch ignitor 10 in a manner to be hereinafter described in detail.

For purposes of describing the remainder of combustion device 12 it is sufficient to note that the device comprises a series of heater tubes 26 at the forward end of combustion chamber 20 over which the hot combustion gasses flow to heat the heater tubes. The hot combustion gasses pass through preheater 15 in the sense indicated by the arrows labeled "EXHAUST OUT". The exhaust flows through the passages of the preheater which are alternate to the passages through which the inlet air flows. In this way a certain amount of heat is extracted from the exiting exhaust gasses and transferred to the inlet air that passes through the preheater thereby preheating the air before it is combusted. The exhaust is finally discharged through an exhaust outlet 27.

Torch ignitor 10 comprises a longitudinal axis 28 which is spaced radially from but is parallel to main axis 16 of combustion device 12. Greater detail of the torch ignitor can be seen in FIGS. 2 and 3.

A circular cylindrical boss 30 is provided on combustion chamber wall 18 coaxial with axis 28. The boss is disposed on the exterior side of the combustion chamber. The forward end of torch ignitor 10 has a particular operative relationship with boss 30, as will be seen in greater detail from the ensuing description.

Wall 19 forms the frontal boundary of a space that contains thermal insulating material 34. A space is provided in the insulating material for receiving a "floating" bushing 36 substantially coaxial with axis 28. Insulating material 34 is preferably a fibrous glass mass so that provision for inserting bushing 36 therein can be fairly easily made. The bushing has flanges via which it is axially captured between wall 19 and a round disk 38 that forms a rear wall for the insulation space. The disk 38 is recessed slightly into the open end of a cylindrical metal part 39 that circumferentially bounds the insulation space. Disk 38 comprises a clearance hole 40 through which the rear end of bushing 36 projects. Wall 19 contains a hole 41 with which the bushing is in alignment.

Additional structure 42 of the combustion device joins part 39 with a further part 44. Part 44 extends axially and contains a bellow section 46 that provides for axial expansion and contraction. The rear, or right hand end, of part 46 has a sliding fit onto a further part 48. This further part 48 has a transverse wall 50 which contains a mounting hole for a fixed bushing 52. The forward, or left hand end, of bushing 52 is shaped to fit into this mounting hole and the bushing is brazed in place on wall 50 coaxial with axis 28.

Torch ignitor 10 comprises an electric ignitor 60, which is of elongate cylindrical shape, and a cylindrical ignitor housing tube 62 within which ignitor 60 is disposed. Ignitor 60 comprises a metal electrode structure that has an exposed forward tip end 64 and a rear terminal end 66. The remainder is covered by ceramic insulation 68. The ceramic insulation is shaped to provide two shoulders 70 and 72 adjacent the forward and rear ends respectively.

Ignitor housing tube 62 comprises a circular cylindrical wall that is of a diameter slightly larger than the outside diameter of the largest part of the ceramic body 68 of the electric ignitor to thereby define an annular free space 74 surrounding the ignitor within tube 62.

Immediately adjacent its forward end, tube 62 is fashioned with an internal bead or shoulder 76. Slightly further rearwardly from shoulder 76, tube 62 is endowed with three radially inwardly directed projections, or dimples, 78 that are equally spaced 120° apart around axis 28. The rear end of tube 62 is provided with a flare 80.

The preferred manner for assembling the torch ignitor 10 into the combustion device comprises first assembling tube 62. The tube is inserted into the device from the right hand end as viewed in FIG. 1. The front end of tube 62 is aligned with and passed through fixed bushing 52. It is then passed through the floating bushing 36. Finally the front end of the tube is telescoped over the rear end of boss 30 until shoulder 76 abuts the rear of boss 30.

It should be noted that during assembly of the various parts of the combustion device, and before the torch ignitor 10 is assembled, it is desirable for an alignment rod to be passed through bushings 52 and 36 and into boss 30 to secure substantial alignment of these three parts for subsequent insertion of the torch ignitor 10 after the alignment rod has been removed.

Despite an initial alignment of the two bushings with boss 30, it has been found desirable for bushing 36 to have a limited amount of float. If bushing 36 is not in precise alignment, it will align when engaged by the forward end of tube 62. The provision of a lead 82 at the rear of the bushing's bore serves to facilitate the alignment of the bushing so that the tube can pass through the bushing and telescope onto the end of boss 30.

With the tube 62 having been installed ignitor 60 is now assembled. Assembly is accomplished by inserting the forward end of the ignitor into the tube via the flared rear end thereof. The ignitor is inserted until shoulder 70 abuts projections 78 at which time the ignitor assumes the position that is portrayed in the drawing figures. As will become more apparent from ensuing description, projections 78 aid in centering the ignitor within the tube.

An O-ring seal 84 is disposed around the ignitor adjacent shoulder 72. Assembly of the ignitor into the ignitor housing tube disposes the O-ring 84 in a sealing relationship between the ignitor and the flare 80 of the ignitor housing tube so that the annular space 74 is sealed off at the rear of the torch ignitor.

A retainer cap 86 is fitted over the end of the ignitor and closely onto flare 80. This retainer cap has a sidewall 88, an end wall 90, and two flanges 92 and 94. The end wall 90 is provided with a circular hole and the flanges 94 is turned inwardly at this hole. Flange 92 is at the opposite end of sidewall 88 and is turned radially outwardly. By virtue of flange 94, the retainer cap serves to capture the O-ring seal 84 axially against shoulder 72 at the same time that the seal closes off the rear end of passage 74.

Figure 4:
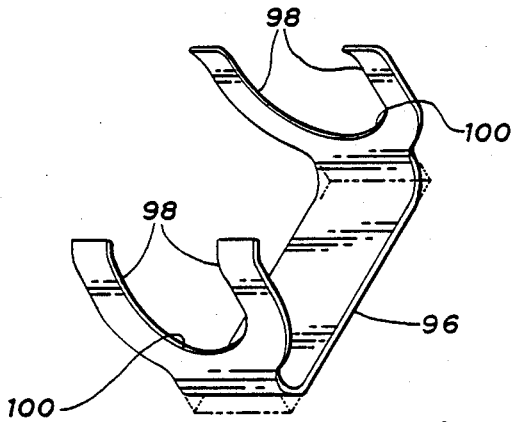
FIG. 4 is a perspective view, on an enlarged scale, of one of the component parts of the torch ignitor by itself.

A retaining clip spring 96 is assembled to both retainer cap 86 and bushing 52. The shape of the retaining clip spring is shown by itself in FIG. 4. As can be seen in that Fig., the retaining clip spring has bifurcations 98 at opposite axial ends. The bifurcations provide a throat 100 at each end enabling the clip spring to be fitted over the outsides of the respective bushing 52 and retainer cap 86. The spring is resiliently flexed when assembled to the bushing and to the retainer cap so that the forward end of the spring bears against the flange of bushing 52 while the rear end of the spring bears against the flange of the retainer cap in a sense which tends to urge the retainer cap toward the fixed bushing. In this way ignitor 60 is urged within tube 62 to maintain shoulder 70 in abutment with projections 78. In this regard it may be desirable to provide a load distribution ring, such as a ring 104, around the ignitor to form shoulder 70, so that projections 78 bear against the load distribution ring for the purpose of distributing the load more uniformly around the ceramic material at the shoulder. The projections 78 are inclined toward the ignitor shoulder and thereby serve to center the ignitor within the tube as the ignitor is resiliently urged against the projections. This gives passage 74 its annular shape.

Figure 2:
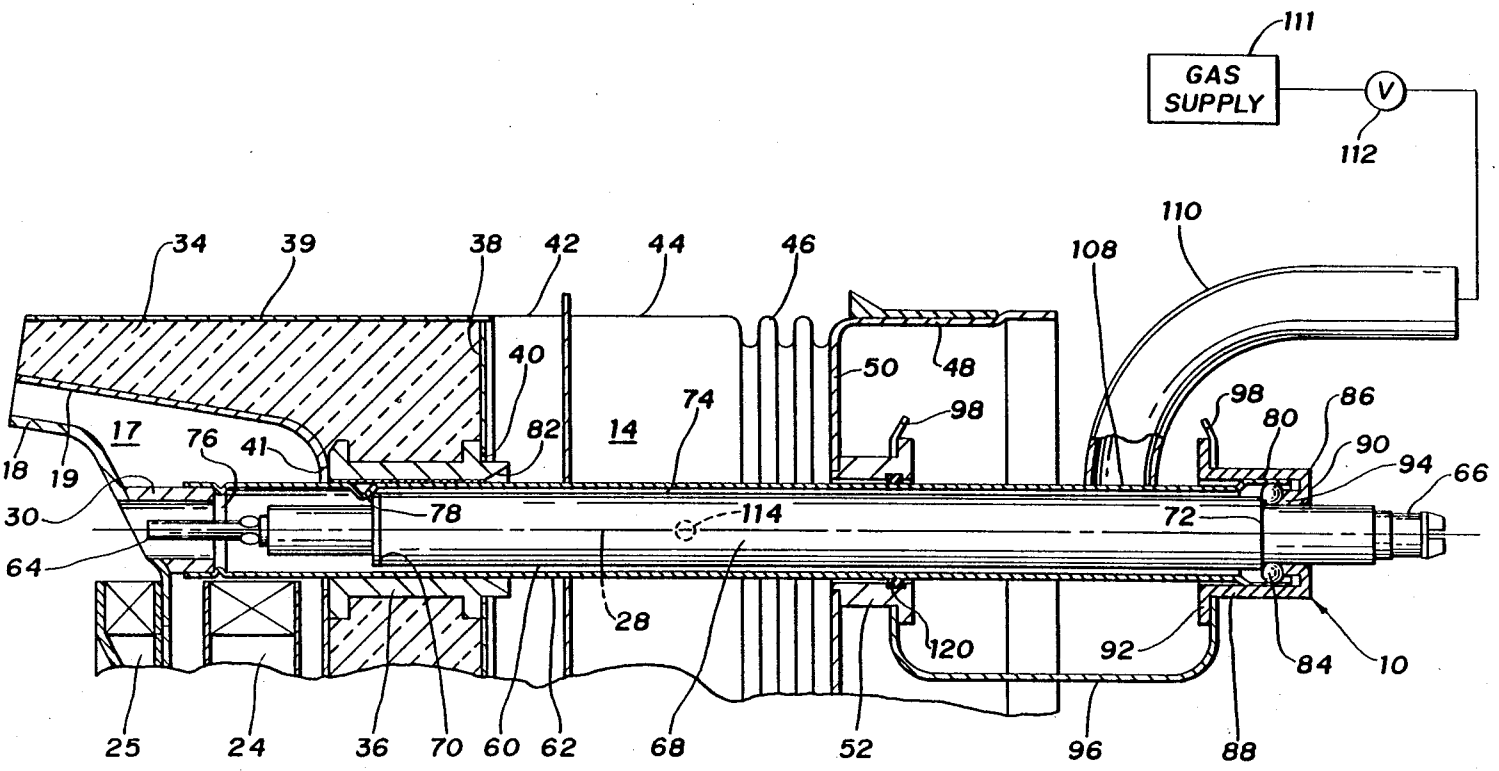
FIG. 2 is a longitudinal view, in partial cross section, through the torch ignitor on an enlarged scale.
Figure 3:
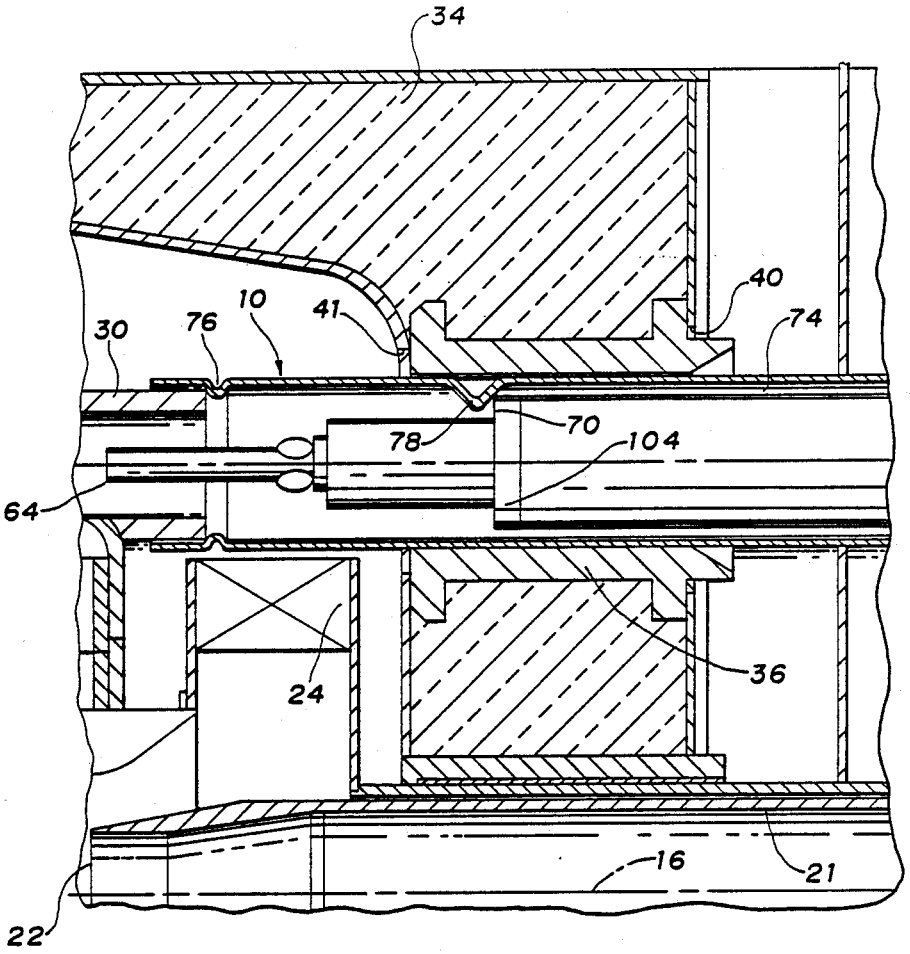
FIG. 3 is a fragmentary enlarged view of the forward end of FIG. 2 for the purpose of illustrating greater detail.

FIG. 2 shows the completed assembly with ignitor 60 accurately located with respect to tube 62 and with tube 62 accurately located with respect to boss 30. The length of tip 64 is dimensioned such that in this condition of installation, the tip remains within the sheltered area defined by the boss and does not project beyond wall 18 into the combustion chamber where it might otherwise be disposed to more erosive effects.

Whenever it is necessary to change the ignitor, all that is necessary is to remove the retention spring clip by displacing it radially to disengage its bifurcated ends from the fixed bushing 52 and the retainer cap 86, removing the retainer cap and then withdrawing the old ignitor, including O-ring 84, from the rear end of tube 62. A fresh ignitor including an O-ring 84 is then reassembled into the tube in reverse manner and the retention clip spring reinstalled. The organization and arrangement insures that the new ignitor tip is accurately located within the sheltered area provided by boss 30. Moreover, any axial expansion and contraction that may occur is absorbed by retention clip spring 96 increasingly and decreasingly flexing. In use, an ignition wire (not shown) is fitted to the tip end 66 and when a voltage is applied via this wire, a spark is created between the electrode tip and the boss.

The remaining matter that needs to be described is how a combustible mixture is created for the torch ignitor and how the torch ignitor functions to ignite the main charge in the combustion chamber. It is the annular passage 74 via which gaseous fuel and air are conveyed to the forward end of the torch ignitor. An orifice 108 is provided in the sidewall of tube 62 slightly forwardly of retainer cap 86. A gas supply tube 110 is fitted to the outside of tube 74 over orifice 108. The gas supply tube 110 is from a gas supply 111 including a solenoid shut-off valve. When valve 112 is actuated to the open position, gas can flow from supply 111 to pass through tube 110 and into the annular passage 74 via orifice 108. The gas is supplied at a suitable pressure which may typically be in the range of 4–10 inches of water.

The gas passes forwardly through passage 74. At approximately the middle of tube 62 there are two further orifices 114 in diametrically opposite sides of tube 62 which provide for communication to air plenum 14. The air pressure is such that air is caused to pass through orifices 114 into the passage 74. The relative pressures of air and gas are such that the flow of the two is toward the forward end of the torch ignitor, and as they travel along the forward half of the torch ignitor from orifices 114, they form a combustible mixture. Because projections 78 are spaced circumferentially apart, the combustible mixture flows past this point of the tube and passes over electrode tip 64.

By electrically energizing ignitor 60, an electric spark is emitted by tip 64 toward boss 30 igniting the combustible mixture that has flowed through passage 74. As a result, a flame is emitted at the forward end of the torch ignitor, and this flame extends into combustion chamber 20.

The introduction of gas via tube 21 and preheated combustion air via the air inlet circuit previously described will create a combustible mixture within combustion chamber 20. The introduction of flame from the torch ignitor will ignite this combustible mixture within the combustion chamber and by maintaining these flows a continuous combustion process will take place within combustion chamber 20 that will heat the heater tubes 26. Because the combustion process is a continuous one, it is unnecessary to continue the flame from torch ignitor 10 and therefore after combustion has been initiated within the combustion chamber, valve 112 may be closed.

It should also be observed that the bore of bushing 52 is slightly oversized relative to the outside diameter of tube 62 to allow for some misalignment. This is a potential leakage source and to guard against such leakage it is desirable to place an O-ring seal 120 inside the bore of bushing 52 so that there is a light sealing contact with the outside wall of tube 62 when the latter is assembled into the combustion device. The sealing force is made relatively light so that there is no undue frictional restriction in passing the tube through the bushing and O-ring.

Based upon the foregoing description a new and unique electric spark type torch ignitor has been disclosed. While the disclosure is that of a preferred embodiment, it will be appreciated that principles of the invention may be embodied in other ways and that the scope of the invention is to be measured by the following claims.

What is claimed is:

1. An electric spark type torch ignitor having a longitudinal axis and comprising an ignitor housing tube having open axially forward and rear ends, an electric ignitor disposed within said ignitor housing tube such that a fluid passageway is cooperatively defined between the interior of said tube and the exterior of said electric ignitor, said electric ignitor having a forward tip end from which an electric spark is emitted when the electric ignitor is electrically energized, means for introducing air and gaseous fuel into said fluid passageway and causing the air and gaseous fuel to pass forwardly within the tube as a mixture and over said tip end of said electric ignitor so that the mixture can be combusted by a spark emitted from the tip end of the ignitor when the electric ignitor is electrically energized to ignite the torch ignitor, locating means within said ignitor housing tube for axially locating the electric ignitor after the electric ignitor has been inserted into the open rear end of the tube, said locating means comprising an abutment for abutting the electric ignitor to limit the extent to which the electric ignitor can be positioned forwardly within said ignitor housing tube, and means, including resilient means, that acts on the electric ignitor to resiliently urge the electric ignitor forwardly within the ignitor housing tube and against said abutment.

2. An electric spark type torch ignitor as set forth in claim 1 in which said abutment comprises surfaces that are disposed at particular circumferential locations about said longitudinal axis and are inclined relative to the longitudinal axis such that in response to the resilient forward urging of the electric ignitor within the ignitor housing tube, said surfaces cause the electric ignitor to be centered within said ignitor housing tube so as to give said fluid passageway an annular transverse cross sectional shape.

3. An electric spark type torch ignitor as set forth in claim 2 in which said surfaces are formed in plural projections that are formed in the wall of said ignitor housing tube.

4. An electric spark type torch ignitor as set forth in claim 3 in which said electric ignitor comprises a shoulder that is spaced rearwardly of said ignitor tip end and is, resiliently urged against said surfaces.

5. An electric spark type torch ignitor as set forth in claim 4 in which said shoulder comprises a load distribution ring that is resiliently urged against said surfaces.

6. An electric spark type torch ignitor as set forth in claim 1 including a shelter chamber for said ignitor tip end, said shelter chamber having an annular shape that is in surrounding relation to said ignitor tip end.

7. An electric spark type torch ignitor as set forth in claim 6 in which said shelter chamber has an open rear end through which said ignitor tip end projects forwardly into the shelter chamber, said ignitor housing tube having additional locating means that abuts the rear end of the shelter chamber to axially locate the ignitor housing tube to the shelter chamber.

8. An electric spark type torch ignitor as set forth in claim 7 in which said additional locating means comprises an internal shoulder formed in the wall of said ignitor housing tube.

9. An electric spark type torch ignitor as set forth in claim 1 in which said which includes said resilient means, that acts on the electric ignitor to resiliently urge the electric ignitor forwardly within the ignitor housing tube and against said abutment comprises a retainer cap that is fitted to the open rear end of the ignitor housing tube and that is acted upon by said resilient means to cause the electric ignitor to be resiliently urged forwardly within the ignitor housing tube.

10. An electric spark type torch ignitor as set forth in claim 9 in which the retainer cap acts on the electric ignitor through an O-ring seal that is disposed around the electric ignitor at a rearwardly facing shoulder thereof, said O-ring seal also forming a seal between the electric ignitor and the ignitor housing tube to seal the rear end of said fluid passageway.

11. An electric spark type torch ignitor as set forth in claim 10 in which said retainer cap comprises a flange and said resilient means comprises a retainer clip spring that fits around a portion of said retainer cap and which exerts a forward force on said retainer cap flange to resiliently urge the retainer cap forwardly.

12. An electric spark type torch ignitor as set forth in claim 11 including a bushing that is disposed in fixed relation to structure on which said ignitor housing tube is disposed and through which said ignitor housing tube passes, said bushing having a flange, said retainer clip spring fitting onto said bushing and bearing against the flange of said bushing to react the resilient forward force that is exerted by the retainer clip spring on said retainer cap.

13. An electric spark type torah ignitor as set forth in claim 1 in which said resilient means comprises a retainer clip spring having bifurcated ends that fit respectively to a flanged bushing and to a flanged retainer cap, said flanged bushing being disposed in fixed relation to structure on which said tube is disposed, said tube passing through said bushing, said flanged retainer cap being fitted to the open rear end of said tube, said retainer clip spring exerting a resilient force on said electric ignitor to resiliently urge the electric ignitor forwardly within the ignitor housing tube and against said abutment while the resilient force is reacted by said bushing.

14. An electric spark type torch ignitor having a longitudinal axis and comprising an ignitor housing tube having open axially forward and rear ends, an electric ignitor disposed with said electric housing tube such that a fluid passageway is cooperatively defined between the interior of said tube and the exterior of said electric ignitor, said electric ignitor having a forward tip end from which an electric spark is emitted when the electric ignitor is electrically energized, means for introducing air and gaseous fuel into said fluid passageway and for causing the air and gaseous fuel to pass forwardly within the tube as a mixture and over said tip end of said electric ignitor so that the mixture can be combusted by a spark emitted from the tip end of the ignitor when the electric ignitor is electrically energized to ignite the torch ignitor, a shelter chamber that is disposed at the forward end of said ignitor housing tube and with respect to which said ignitor housing tube has a sliding fit, a shoulder formed at the forward end of said ignitor housing tube for axially locating the ignitor housing tube with respect to the shelter chamber, and locating means within said ignitor housing tube for axially locating the electric ignitor within the ignitor housing tube after the electric ignitor has been inserted into the ignitor housing tube via the open rear end thereof whereby the tip end of said ignitor is located within the shelter chamber by the ignitor housing tube.

15. An electric spark type torch ignitor as set forth in claim 14 including resilient means acting to urge the electric ignitor forwardly within the ignitor housing tube and against said locating means.

* * * * *